US006817691B2

(12) United States Patent
Umeda

(10) Patent No.: US 6,817,691 B2
(45) Date of Patent: Nov. 16, 2004

(54) HEAD DRIVER FOR LIQUID JETTING APPARATUS

(75) Inventor: Atsushi Umeda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/351,598

(22) Filed: Jan. 27, 2003

(65) Prior Publication Data

US 2003/0142155 A1 Jul. 31, 2003

(30) Foreign Application Priority Data

Jan. 25, 2002 (JP) ..... P2002-016972

(51) Int. Cl.[7] ..... B41J 29/38
(52) U.S. Cl. ..... 347/9

(58) Field of Search ..... 347/19, 9–11, 347/92, 5, 14, 74, 75

(56) References Cited

U.S. PATENT DOCUMENTS 3,828,357 A * 8/1974 Koeblitz ..... 347/10

* cited by examiner

*Primary Examiner*—Thinh Nguyen
*Assistant Examiner*—Julian D. Huffman
(74) *Attorney, Agent, or Firm*—Sughrue Mion, PLLC

(57) ABSTRACT

A head drive circuit is adapted to selectively drive piezoelectric elements for ejecting liquid droplets from a liquid jetting head of a liquid jetting apparatus. A charger is adapted to apply a bias voltage to ground-side electrodes of the piezoelectric elements. An anomalous voltage detector outputs a detection signal when a charging voltage of the charger is a predetermined value or more.

10 Claims, 5 Drawing Sheets

HEAD DRIVER FOR LIQUID JETTING APPARATUS

BACKGROUND OF THE INVENTION

The invention relates to a technique for driving a liquid jetting head of a liquid jetting apparatus such as an ink jet printer, wherein ground-side electrodes of piezoelectric elements provided in the liquid jetting head so as to be associated with nozzle orifices to be used for jetting liquid droplets, are held at a predetermined bias voltage.

Various kinds of the liquid jetting apparatus have hitherto been known. For example, there have been known an ink jet printer which records information on recording paper by jetting ink droplets, an electrode forming apparatus which forms an electrode on a board by jetting liquid-state electrode material, a biochip manufacturing apparatus which manufactures a biochip by jetting biological specimen, and a micropipette for jetting a predetermined amount of sample into a vessel.

Ink jet color printers which eject color ink from a recording head have become pervasive as computer output devices. The printers are widely used for printing images, which have been processed by a computer, in multiple colors and gradations.

For instance, in an ink jet printer employing piezoelectric elements as drive elements for ejecting ink, a plurality of piezoelectric elements, which are provided so as to correspond to a plurality of nozzle orifices of a print head, are selectively activated, whereby ink droplets are ejected from the nozzle orifices in accordance with the dynamic pressure developing in the respective piezoelectric elements. Dots are formed on print paper by causing the ink droplets to adhere to the print paper, thus effecting printing operation.

Here, the piezoelectric elements are provided so as to correspond to nozzle orifices to be used for ejecting ink droplets. The piezoelectric elements are actuated by a drive signal supplied from a driver IC (i.e., a head drive circuit) mounted in the print head, thereby ejecting ink droplets.

Such a head driver is configured in a manner shown in FIG. 4.

As shown in this figure, a head driver 1 comprises piezoelectric elements 2 provided so as to correspond to respective nozzle orifices; a head drive circuit 3 to be used for supplying a drive signal to a first electrode 2*a* of each piezoelectric element 2; and a current amplifier 4 and a switcher 5, both being interposed between the head drive circuit 3 and the respective piezoelectric elements 2.

The piezoelectric elements 2 are configured so as to become deformed by a voltage applied across electrodes 2*a* and 2*b*.

The head drive circuit 3 provides a drive signal COM to the head of the ink jet printer and is provided in, e.g., a printer main unit.

The current amplifier 4 is constituted of two transistors 4*a*, 4*b*. Of the transistors, a collector of the first transistor 4*a* is connected to a constant voltage source, and a base of the same is connected to one of outputs of the head drive circuit 3. Further, an emitter of the transistor 4*a* is connected to an input terminal of the switcher 5. In accordance with the signal output from the head drive circuit 3, a constant voltage Vcc is supplied to the piezoelectric elements 2 by way of the switcher 5.

An emitter of the second transistor 4*b* is connected to the input terminal of the switcher 5, and a base of the same is connected to a second output terminal of the head drive circuit 3. Further, a collector of the second transistor 4*b* is grounded. As a result, the second transistor 4*b* is brought into conduction in accordance with a signal output from the head drive circuit 3, thereby causing the piezoelectric elements 2 to discharge by way of the switcher 5.

Upon receipt of a control signal, the switcher 5 is activated at a timing at which a corresponding piezoelectric element 2 is activated, whereby the drive signal COM is output to that piezoelectric element 2.

In fact, the switcher 5 is constituted of a so-called transmission gate to be used for activating and deactivating the respective piezoelectric elements 2.

Here, the head driver 1 having such a configuration often causes an anomaly, such as a short-circuit or a rare short-circuit, for reasons of a failure arising in any piezoelectric element 2 or a like reason. In such a case, when the constant voltage Vcc is applied to the piezoelectric elements 2 by way of the switcher 5 as a result of the first transistor 4*a* of the current amplifier 4 being turned on, an anomalous current flows into the piezoelectric elements 2 through the constant voltage Vcc.

Therefore, in order to prevent flow of the anomalous current into the piezoelectric elements 2, which would otherwise be caused by the constant voltage Vcc, a fuse 6 has hitherto been interposed between the constant voltage Vcc and the collector of the first transistor 4*a*.

In the event that a short-circuit or rare short-circuit has arisen in any of the piezoelectric elements 2, if an anomalous current flows into the head driver 1, the fuse 6 is disconnected by the anomalous current, thereby preventing flow of the anomalous current into the piezoelectric elements 2.

When such piezoelectric elements remain in a non-actuated state (i.e., when printing is not performed), the electric charges accumulated in the piezoelectric elements as a result of charging operation are discharged by insulation resistance, whereby the voltages of the piezoelectric elements are lowered, possibly affecting ejection of ink.

Therefore, there has also been known a head driver, in which ground-side electrodes of respective piezoelectric elements are held at a bias potential; for example, an intermediate potential of a drive signal. Such a head driver is configured as shown in FIG. 5.

As shown in this figure, a head driver 7 is substantially identical in configuration with the head driver 1 shown in FIG. 4. A capacitor 8 serving as a charger to be charged by a constant voltage Vc1 is connected to a second electrode 2*b* in each of the piezoelectric elements 2.

As a result, the remaining electrodes 2*b* of the piezoelectric elements 2 are held at a bias voltage originating from the capacitor 8 serving as charger. The voltage developing across the electrodes 2*a*, 2*b* of the piezoelectric elements 2 is diminished, thereby preventing discharge, which would otherwise arise in electrodes of the piezoelectric elements when packing density of the piezoelectric elements is increased.

However, as mentioned previously, when a short-circuit or rare short-circuit has arisen in each of the piezoelectric elements of the head driver 7 of such a configuration, a bias voltage originating from the capacitor 8 serving as the charger is applied to the remaining electrodes 2*b* of the piezoelectric elements 2, whereby the voltage across the electrodes 2*a*, 2*b* of the piezoelectric elements 2 is lowered. Hence, if an anomalous current flows from the constant voltage Vcc, no sufficiently-large anomalous current will flow. As a result, blowing of the fuse 6 is prevented, whereupon the anomalous current flows into the piezoelectric elements 2.

For this reason, a print head is equipped with a temperature detector, thereby detecting a rise in the temperatures of the piezoelectric elements 2 induced by an anomalous current.

SUMMARY OF THE INVENTION

It is an object of the invention to provide a head driver for a liquid jetting apparatus arranged so as to reliably detect occurrence of short-circuit or rare short-circuit in a piezoelectric element.

In order to achieve the above object, according to the invention, an anomalous voltage arising in ground-side electrodes of piezoelectric elements is detected on the basis of a charging voltage of a charger for applying a bias voltage to the ground-side electrodes of the piezoelectric elements.

Specifically, there is provided a head driver for a liquid jetting apparatus, comprising:

- a head drive circuit, adapted to selectively drive piezoelectric elements for ejecting liquid droplets from a liquid jetting head;
- a charger, adapted to apply a bias voltage to ground-side electrodes of the piezoelectric elements; and
- an anomalous voltage detector, which outputs a detection signal when a charging voltage of the charger is a predetermined value or more.

In such a configuration, in the event that an anomaly, such as a short-circuit or rare short-circuit, has arisen in the piezoelectric elements, an anomalous current flows into the charger by way of the piezoelectric elements. The charger is further charged by the anomalous current. Since the charging voltage of the charger is eventually increased, the anomalous voltage detector outputs the detection signal when the charging voltage becomes the predetermined value or more.

Accordingly, a control section of a liquid jetting apparatus can detect occurrence of an anomaly, such as a short-circuit or rare short-circuit, arising from a failure in the piezoelectric elements of the head driver, in accordance with the detection signal output from the anomalous voltage detector.

Further, upon receipt of the detection signal from the anomalous voltage detector of the head driver, the control section may controls the head driver so as to temporarily suspend the liquid jetting operation. On some occasions, the control section forcefully terminates the liquid jetting operation, thereby preventing destruction of the liquid jetting head, which would otherwise be caused by an anomalous current flowing through the piezoelectric elements.

In this way, in the event that an anomaly, such as a short-circuit or rare short-circuit, arising from a failure in the piezoelectric elements has arisen, the head driver of the invention can detect an anomalous voltage attributable to an anomalous current flowing through the ground-side electrodes of the piezoelectric elements even when the bias voltage such as an intermediate potential is applied to the ground-side electrodes of the piezoelectric elements.

In this case, an anomalous voltage developing in the ground-side electrodes of the piezoelectric elements can be detected through use of a simple configuration embodied by addition of only the anomalous voltage detector for monitoring the charging voltage of the charger to a related-art head driver. Hence, a fuse provided for a constant voltage is obviated, thereby diminishing costs of components.

Preferably, the anomalous voltage detector includes a switching element which changes a conduction state thereof when the charging voltage of the charger is a predetermined value or more.

In such a configuration, a threshold value of the charging voltage of the charger to be used for activating or deactivating the switching element is set so as to become slightly higher than the charging voltage of the charger employed during normal operating conditions. As a result, an anomalous current flows into the piezoelectric elements. When the charging voltage of the charger has increased, the switching elements are activated or deactivated, whereupon a detection signal is output while being reversed from a high level to a low level or vice versa.

More specifically, the anomalous voltage detector divides the charging voltage of the charger by a voltage-dividing resistor, thereby producing an appropriate voltage. The switching element, such as a transistor, is turned on or off by such a voltage. Therefore, an anomalous voltage developing in the ground-side electrodes of the piezoelectric elements can be detected through use of a considerably simple configuration embodied by addition of a mere voltage-dividing resistor or switching element to the related-art head driver.

Alternatively, it is preferable that the anomalous voltage detector includes a comparator which switches an output level thereof when the charging voltage of the charger is a predetermined value or more.

In such a configuration, a reference voltage of the comparator is set so as to become slightly higher than the charging voltage of the charger employed during normal operating conditions. If the charging voltage of the charger has increased as a result of flow of the anomalous current into the piezoelectric elements, the comparator outputs a signal while being reversed from a high level to a low level or vice versa.

According to the invention, there is also provided a liquid jetting apparatus, comprising:

- a liquid jetting head, provided with nozzle orifices;
- piezoelectric elements, associated with the nozzle orifices to eject liquid droplets therefrom;
- a head drive circuit, which selectively drives the piezoelectric elements;
- a charger, which applies a bias voltage to ground-side electrodes of the piezoelectric elements; and
- an anomalous voltage detector, which outputs a detection signal when a charging voltage of the charger is a predetermined value or more.

According to the invention, there is also provided a method of driving a liquid jetting head provided with piezoelectric elements which are selectively driven to eject liquid droplets, the method comprising steps of:

- applying a bias voltage to ground-side electrodes of the piezoelectric elements by a charger;
- detecting whether a charging voltage of the charger is predetermined value or more; and
- outputting an anomalous signal when it is detected that the charging voltage is predetermined value or more.

Preferably, the anomalous signal is outputted through a switching element which changes a conduction state thereof when it is detected that the charging voltage is predetermined value or more.

Alternatively, it is preferable that the anomalous signal is outputted through a comparator which switches an output level thereof when it is detected that the charging voltage is predetermined value or more.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A head driver according to embodiments of the invention will be described hereinbelow by reference to the accompanying drawings. The embodiments to be described hereinbelow are preferred specific embodiments of the invention, and hence technically-preferable limitations are imposed on the embodiments. However, the scope of the invention is not limited to the embodiments unless the below descriptions include descriptions which particularly specify the invention.

Figure 1:
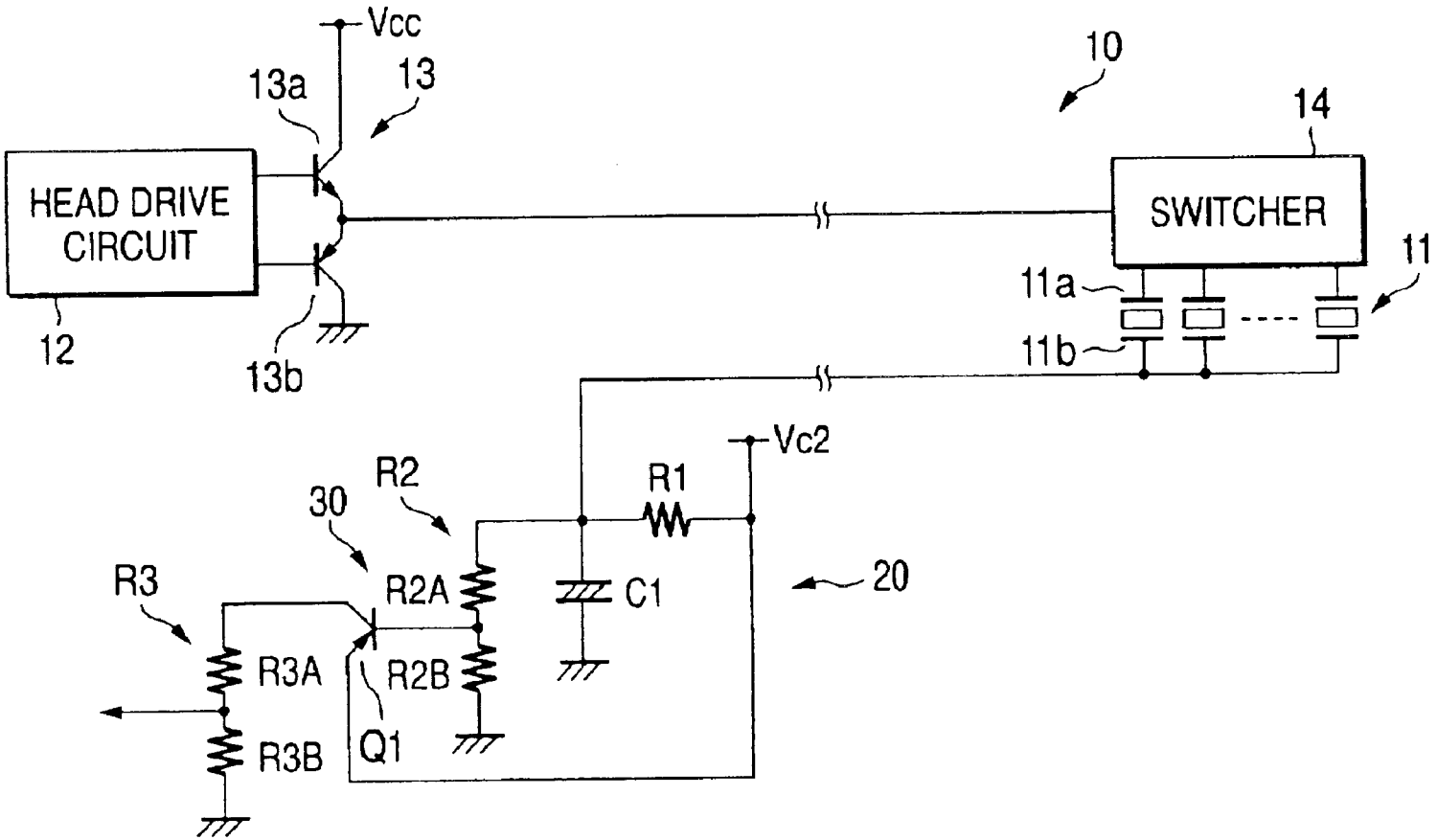
FIG. 1 is a block diagram showing the configuration of a head driver according to a first embodiment of the invention.

FIG. 1 shows the configuration of a head driver of an ink jet printer, which is one kind of a liquid jetting apparatus, according to a first embodiment of the invention.

As shown in FIG. 1, a head driver 10 comprises piezoelectric elements 11 provided so as to correspond to a plurality of nozzle orifices of a print head which is one kind of a liquid jetting head; a head drive circuit 12 for supplying a drive signal to electrodes 11*a* of the respective piezoelectric elements 11; a current amplifier 13 and a switcher 14, both being interposed between the head drive circuit 12 and the respective piezoelectric elements 11; a bias power supplier 20 for applying a predetermined bias voltage to ground-side electrodes 11*b* of the piezoelectric elements 11; and an anomalous voltage detector 30.

A row of nozzle orifices are provided for each color in a print head of the ink jet printer 10. In relation to FIG. 1, the piezoelectric elements 11 are provided for each of the rows of nozzle orifices.

A drive signal COM output from the head drive circuit 12 is sequentially output to the piezoelectric elements 11 of the respective nozzle orifice rows via shift registers or the like.

The piezoelectric elements 11 are embodied by, e.g., elements exhibiting the piezoelectric effect and formed so as to become deformed by a voltage applied across the electrodes 11*a* and 11*b*.

The piezoelectric elements 11 remain charged at all times in the vicinity of an intermediate potential Vc. The piezoelectric elements 11 are arranged so as to eject droplets from nozzle orifices by applying pressure to the ink stored in corresponding nozzle orifices when discharging in accordance with the drive signal COM output from the head drive circuit 12.

The head drive circuit 12 produces a drive signal COM to be sent to the print head and is placed in, e.g., a main unit of the printer.

The current amplifier 13 is constituted of two transistors 13*a*, 13*b*.

Of these transistors, a collector of the first transistor 13*a* is connected to a constant voltage power supply (e.g., a DC power supply of +42V), and a base of the same is connected to one of output terminals of the head drive circuit 12. Further, an emitter of the first transistor 13*a* is connected to an input terminal of the switcher 14. As a result, in accordance with the signal output from the head drive circuit 12, the first transistor 13*a* is brought into conduction, thereby supplying a constant voltage Vcc to the piezoelectric elements 11 via the switcher 14.

An emitter of the second transistor 13*b* is connected to the input terminal of the switcher 14, and a base of the same is connected to a second output terminal of the head drive circuit 12. Further, a collector of the second transistor 13*b* is grounded. As a result, the second transistor 13*b* is brought into conduction in accordance with the signal output from the head drive circuit 12, thereby causing the piezoelectric elements 11 to discharge via the switcher 14.

Upon receipt of the control signal, the switcher 14 is turned on at the timing at which a corresponding piezoelectric element 11 is to be activated, thereby outputting the drive signal COM to that piezoelectric element 11.

The switcher 14 is arranged as a so-called transmission gate for activating or deactivating the respective piezoelectric elements 11.

The bias power supplier 20 is constituted of a capacitor C1 serving as a charger.

The capacitor C1 is an electrolytic capacitor. One end of the capacitor C1 is connected to the ground-side electrodes 11*b* of the piezoelectric elements 11 so as to apply a charging voltage of the capacitor; that is, a bias voltage Vb, to the ground-side electrodes 11*b* of the respective piezoelectric elements 11. Further, the other end of the capacitor C1 is grounded.

The capacitance of the capacitor C1 is selected so as to assume sufficient capacitance with respect to a total amount of electrostatic capacitance of all the piezoelectric elements 11 (several microfarads; e.g., 1.4 $\mu$F); that is, thousands of microfarads (e.g., approximately 3300 $\mu$F) so that a stable bias voltage Vb can be supplied to the respective piezoelectric elements 11.

One end of the capacitor C1 is connected to a second constant voltage power supply via a current limitation resistor R1.

The second constant voltage power supply is, e.g., a DC power supply of +5V and arranged to charge the capacitor C1, by applying a constant voltage Vc2 to the capacitor C1 by way of the current limit resistor R1.

In this way, the bias power supplier 20 outputs, to the ground-side electrodes 11*b* of the piezoelectric elements 11, a predetermined bias voltage Vb, preferably, a voltage substantially equal to the intermediate potential Vc of the drive signal COM output from the head drive circuit 12.

The anomalous voltage detector 30 is constituted of two voltage-dividing resistors R2, R3 and a switching transistor Q1.

The first voltage-dividing resistor R2 is formed from two resistors R2A and R2B, which are connected in series between one end of the capacitor C1 of the bias power supplier 20 and a ground.

A base of the switching transistor Q1 is connected to a junction located between the resistors R2A and R2B of the voltage-dividing resistor R2, and an emitter of the same is connected to the second constant voltage power supply.

The second voltage-dividing resistor R3 is formed from two resistors R3A and R3B, which are connected in series between the collector and ground of the switching transistor Q1.

A junction located between the resistors R3A, R3B of the voltage-dividing resistor R3 is connected to, e.g., a control section of the printer main unit, whereby a voltage resulting from division of a voltage performed by the voltage-dividing resistor R3 is output as a detection signal.

Thus, when the charging voltage of the capacitor C1 of the bias power supplier 20 is normal; that is, the constant voltage Vc2, the switching transistor Q1 of the anomalous voltage detector 30 is turned on, whereupon a high-level signal resulting from division of the constant voltage Vc2 performed by the second voltage-dividing resistor R3 is output.

In the event that an anomalous current flows from the constant voltage Vcc as a result of occurrence of an anomaly, such as a short-circuit or a rare short-circuit, in the piezoelectric elements 11, to thereby increase the charging voltage of the capacitor C1, the base voltage of the switching transistor Q1 is increased, thereby turning off the switching transistor Q1 and outputting a low-level signal.

The head driver 10 of the embodiment is constructed in the manner mentioned above and operates in the following manner.

First, when power is turned on, the head drive circuit 12 outputs the drive signal COM. Then, the drive signal COM activates the first transistor 13*a* of the current amplifier 13, and an electric current flows into the electrodes 11*a* of the piezoelectric elements 11 from the first constant voltage power supply by way of the switcher 14, thereby charging the electrodes 11*a*. As a result, the electrodes 11*a* of the piezoelectric elements 11 gradually increase in voltage to the intermediate potential Vc.

The bias power supplier 20 charges the capacitor C1 with the second constant voltage power supply. The charging voltage of the capacitor C1 is applied as the bias voltage Vb to the ground-side electrodes 11*b* of the piezoelectric elements 11, as a result of which the potential of the ground-side electrodes 11*b* reaches the bias voltage Vb.

Accordingly, a potential difference between the electrodes 11*a*, 11*b* of the piezoelectric elements 11 becomes substantially zero.

This completes the operation to be performed by the head driver 10 at the initial activation.

When printing is commenced, the head drive circuit 12 outputs the drive signal COM. If the drive signal COM is determined to be higher than the intermediate potential Vc on the basis of fluctuations in drive signal COM, the electrodes 11*a* of the piezoelectric elements 11 are charged by way of the first transistor 13*a* of the current amplifier 13. If the drive signal COM is determined to be lower than the intermediate potential Vc, the electrodes 11*a* of the piezoelectric elements 11 are caused to discharge by way of the second transistor 13*b*. Then, the piezoelectric elements 11 operate on the basis of the drive signal COM, thereby ejecting ink droplets.

At this time, the bias power supplier 20 applies the bias voltage Vb to the ground-side electrodes 11*b* of the piezoelectric elements 11, whereby the electrodes 11*b* are held at the bias voltage Vb at all times.

Accordingly, in the anomalous voltage detector 30, the bias voltage Vb equal to the constant voltage Vc2 of the second constant voltage power supply is applied to the base of the switching transistor Q1 after having been divided by the first voltage-dividing resistor R2, and the constant voltage Vc2 of the second constant voltage power supply is applied directly to the emitter of the same. Hence, the base voltage is higher than the emitter voltage, so that the switching transistor Q1 remains active.

The constant voltage Vc2 is divided by the second voltage-dividing resistor R3 by way of the switching transistor Q1, and a high-level signal Vcpu is output.

If an anomaly, such as a short-circuit or a rare short-circuit, arises in the piezoelectric elements for reasons of a failure, to thereby cause a short-circuit between the electrodes 11*a*, 11*b* of the piezoelectric elements 11, a constant voltage Vcc is applied to the piezoelectric elements 11 from the first constant voltage power supply by way of the first transistor 13*a* of the current amplifier 13 when the drive signal COM is higher than the intermediate potential Vc. The constant voltage Vcc is applied to the capacitor C1 of the bias power supplier 20, and an anomalous current flows into the capacitor C1 through the piezoelectric elements 11. As a result, the capacitor C1 is charged, and the charging voltage of the capacitor becomes higher than the constant voltage vc2 of the second constant voltage power supply.

Accordingly, in connection with the anomalous voltage detector 30, a partial potential yielded by the first voltage-dividing resistor R2 becomes higher. When the partial voltage has become higher than the constant voltage Vc2, the base voltage of the switching transistor Q1 becomes higher than the emitter voltage. Consequently, the switching transistor Q1 is turned off, whereupon the low-level signal Vcpu is output by way of the second voltage-dividing resistor R3.

A threshold voltage Vref for the charging voltage of the capacitor C1 at which the switching transistor Q1 is turned off is given by $$Vref = Vc2\frac{RA + RB}{RB}$$

Figure 2A:
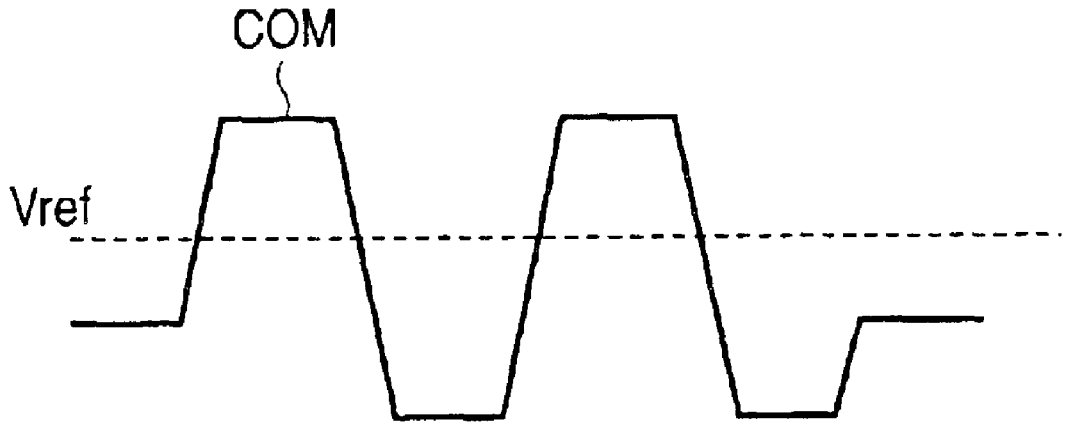
FIGS. 2A and 2B are timing charts showing a relationship between a drive signal output from a head drive circuit and a signal output from an anomalous voltage detector.
Figure 2B:
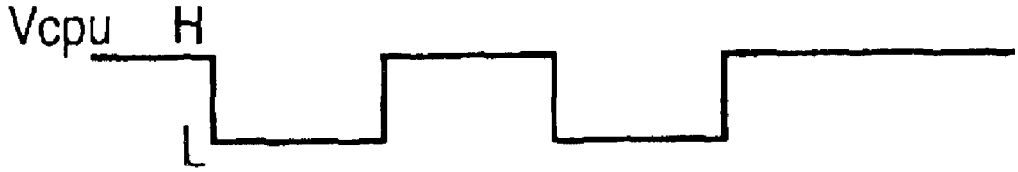

As shown in FIG. 2, in the event that a short-circuit has arisen in the piezoelectric elements 11 as a result of occurrence of an anomaly, the signal Vcpu output from the anomalous voltage detector 30 produces a low-level pulse every time the drive signal COM exceeds the threshold value Vref in association with fluctuations in the pulse of the drive signal COM.

When the output signal Vcpu is at a high level, the control section of the printer main unit determines that the piezoelectric elements 11 operate normally. When the output signal Vcpu is a low-level pulse, an anomalous voltage is determined to have arisen in the piezoelectric elements 11.

The control section of the printer main unit can temporarily stop printing operation by controlling, e.g., the head driver. In some instances, the control section can prevent destruction of the print head, which would otherwise be caused by the anomalous current flowing from the piezoelectric elements, by forcefully terminating printing operation.

Figure 3:
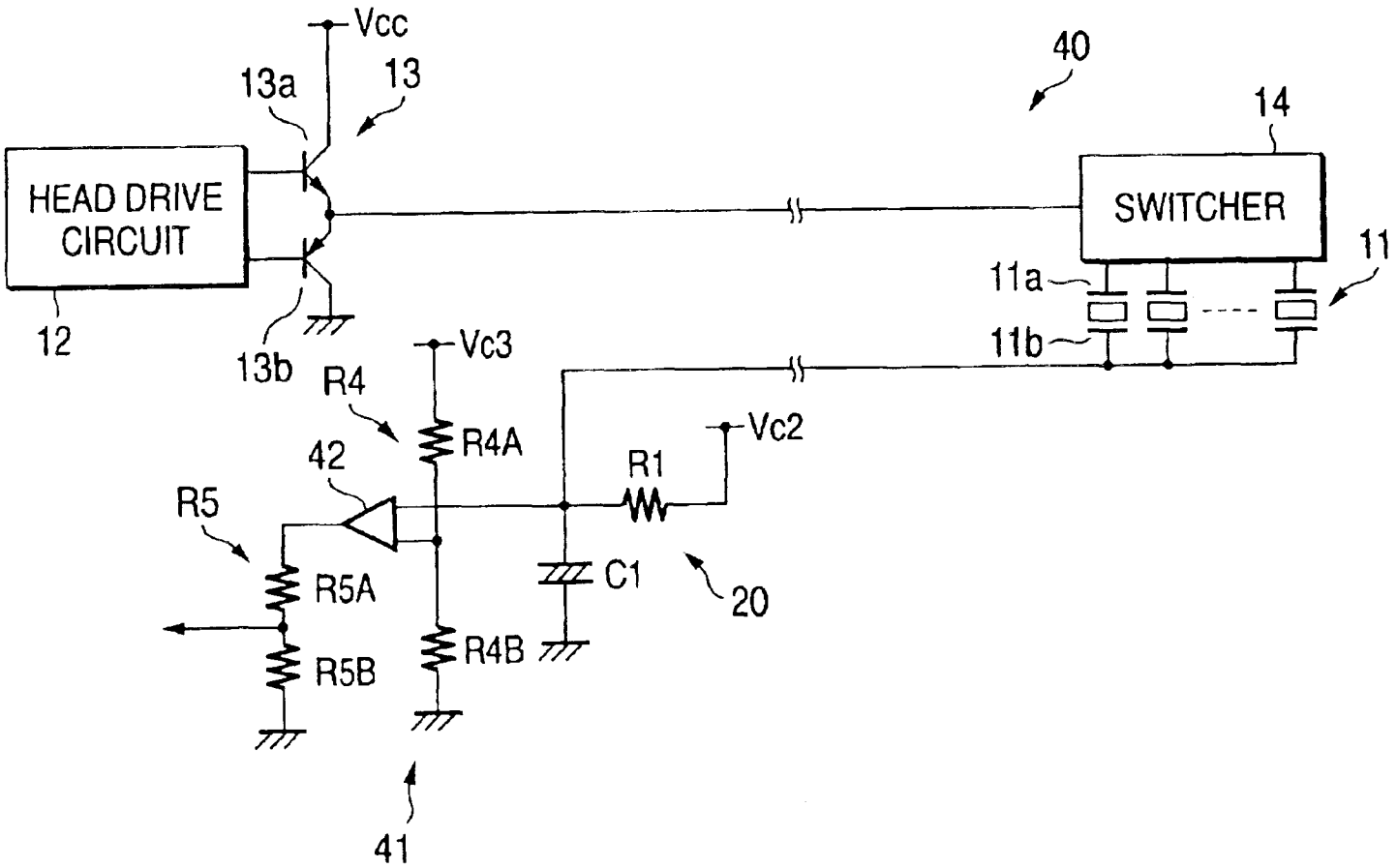
FIG. 3 is a block diagram showing the configuration of a head driver according to a second embodiment of the invention.

FIG. 3 shows the configuration of a head driver of an ink jet printer according to a second embodiment of the invention.

As shown in this figure, a head driver 40 is substantially identical in configuration with the head driver 10 of the first embodiment shown in FIG. 1. A mere difference between the head drivers 10 and 40 lies in that an anomalous voltage detector 41 is provided in lieu of the anomalous voltage detector 30.

The anomalous voltage detector 41 is constituted of two voltage-dividing resistors R4 and R5, and a comparator 42.

The voltage-dividing resistor R4 is formed from two resistors R4A, R4B, which are connected in series between a third constant voltage power supply and a ground. A third constant voltage power supply Vc3 is divided, to thereby produce a reference potential.

One input terminal of the comparator 42 is connected to one end of the capacitor C1 of the bias power supplier 20. The other input terminal of the same is connected to a junction located between the two resistors R4A, R4B of the voltage-dividing resistor R4.

The voltage-dividing resistor R5 is formed from two resistors R5A, R5B, which are connected in series between an output terminal of the comparator 42 and a ground.

A junction located between the resistors R5A, R5B of the voltage-dividing resistor R5 is connected to, e.g., the control section of the printer main unit, and a partial voltage yielded by the voltage-dividing resistor R5 is output as a detection signal.

As a result, when a charging voltage of the capacitor C1 of the bias power supplier 20 is normal; that is, the constant voltage Vc2, the charging voltage of the capacitor C1 to be input to a first input terminal of the comparator 42 is lower than the reference potential to be input to a second input terminal of the comparator 42. Hence, the comparator 42 outputs a high-level signal.

In contrast, when the charging voltage of the capacitor C1 has increased as a result of occurrence of an anomaly in the piezoelectric elements 11, the charging voltage of the capacitor C1 to be input to the first input terminal of the comparator 42 becomes higher than the reference potential. Hence, the comparator 42 outputs a low-level signal.

The head driver 40 of such a configuration operates in the same fashion as does the head driver shown in FIG. 1. Further, in the event that the charging voltage of the capacitor C1 has increased as a result of an anomalous current flowing into the capacitor C1 from the piezoelectric elements 11 for reasons of occurrence of an anomaly in the piezoelectric elements 11, the anomalous voltage detector 41 outputs a low-level pulse signal corresponding to fluctuations in the pulse of the drive signal COM.

Accordingly, for example, when the output signal Vcpu is at a high level, the control section of the printer main unit determines that the piezoelectric elements 11 operate normally. In contrast, when the output signal Vcpu is a low-level pulse, the control section determines that an anomalous voltage has arisen in the piezoelectric elements 11.

In the foregoing embodiments, the anomalous voltage detectors 30, 41 output a high-level signal under normal operating conditions. In the event that an anomaly has arisen in the piezoelectric elements 11, the detectors 30, 41 output a low-level pulse signal corresponding to the drive signal COM. However, the invention is not limited to these operations. For example, during normal operating conditions, the detectors 30, 41 may output a low-level signal. In contrast, in the event that an anomaly has arisen in the piezoelectric elements 11, a high-level pulse signal corresponding to the drive signal COM may be output.

In the embodiment, the bias power supplier 20 is arranged to output a bias voltage Vb equal to the intermediate voltage Vc of the drive signal COM output from the head drive circuit 12. However, the invention is not limited to such an arrangement. The bias power supplier 20 may output a bias voltage Vb deviated from the intermediate voltage Vc.

In this case, a voltage across the electrodes 11*a*, 11*b* of the piezoelectric elements 11 does not become substantially zero. However, when compared with a case where no bias voltage is employed, a potential difference between the electrodes 11*a*, 11*b* becomes smaller. Hence, power to be dissipated by the piezoelectric elements is diminished, whereby a voltage drop attributable to natural discharge of the piezoelectric elements becomes smaller, thereby reducing a power loss.

In the embodiments, the switching transistor and the comparator are used in the anomalous voltage detectors 30, 41 for detecting a rise in the charging voltage of the capacitor C1 serving as the charger. However, the invention is not limited to the elements. As is obvious, another switching element or a differential circuit may also be employed. Moreover, an element other than a capacitor can also be employed as the charger.

Figure 4:
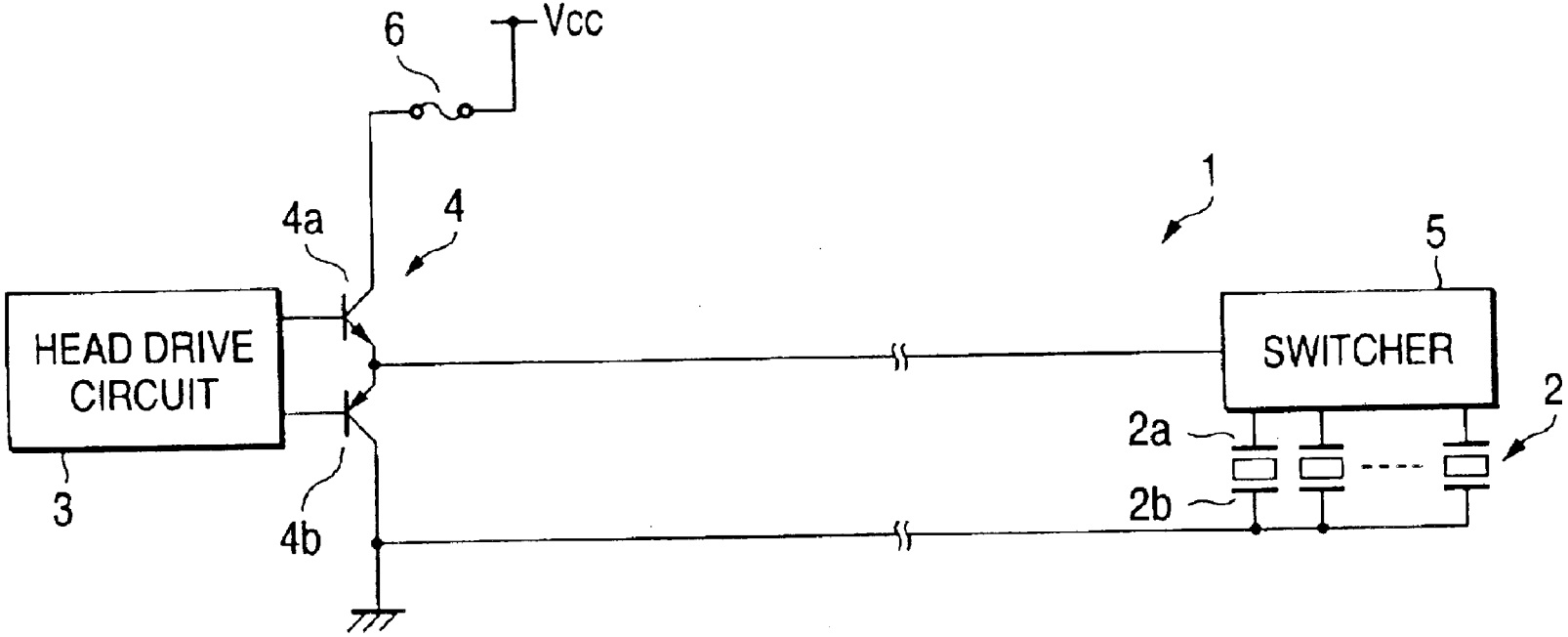
FIG. 4 is a block diagram showing the configuration of a first related-art head driver.
Figure 5:
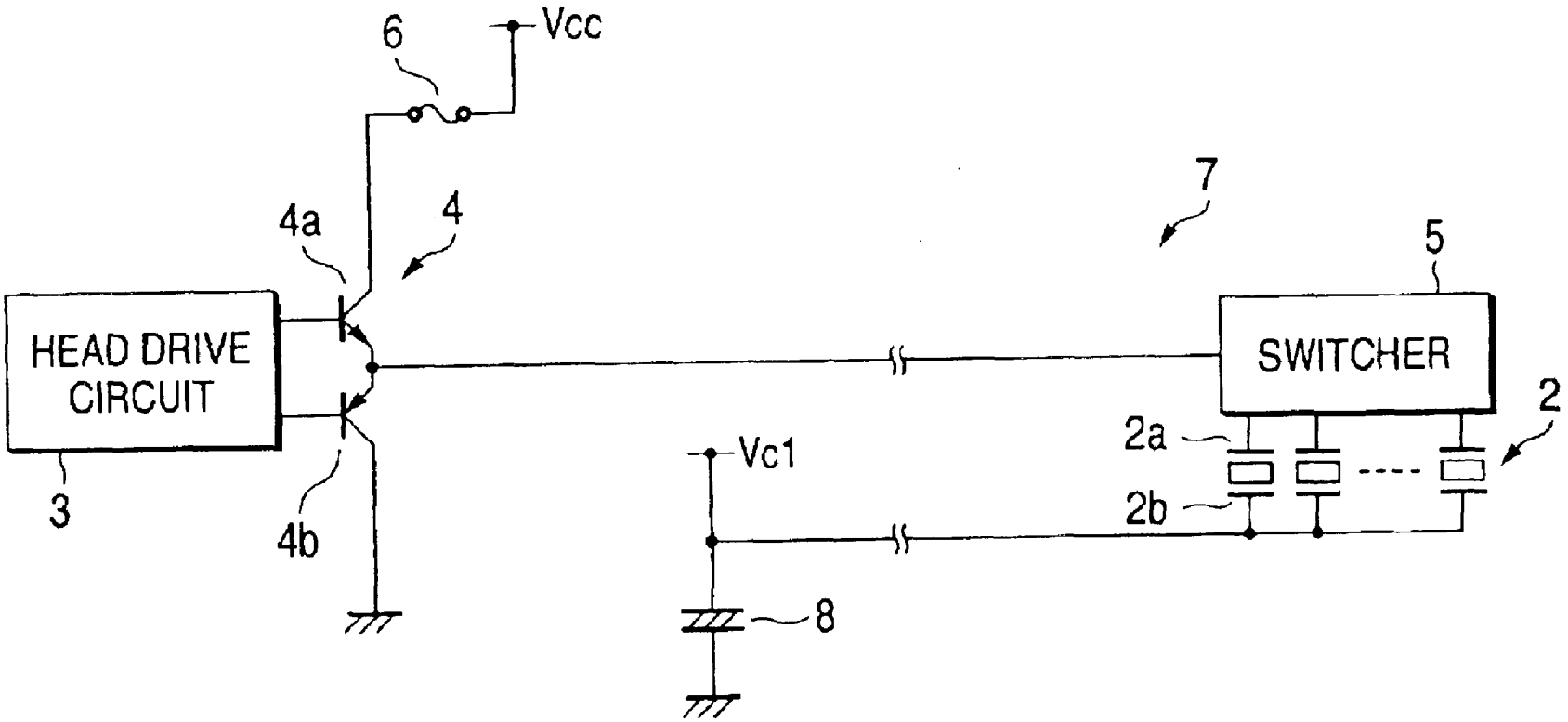
FIG. 5 is a block diagram showing an example configuration of a second related-art head circuit having a bias power supplier.

In the above embodiments, although the fuse 6 of the related-art head driver 1 shown in FIG. 4 is omitted from the embodiments, such a fuse may also be provided in the head driver. Furthermore, as is obvious, the circuit for detecting the temperature of the print head explained in connection with the head driver 7 shown in FIG. 5 may be additionally employed in the embodiment.

The invention can be also applied to display manufacturing apparatuses, electrode forming apparatuses, biochip manufacturing apparatuses, or various types of liquid jetting apparatuses, as well as ink jet printers.

What is claimed is:

1. A head driver for a liquid jetting apparatus, comprising:

a head drive circuit, adapted to selectively drive piezoelectric elements for ejecting liquid droplets from a liquid jetting head;

a charger, adapted to apply a bias voltage to ground-side electrodes of the piezoelectric elements; and an anomalous voltage detector, which outputs a detection signal in accordance with a charging voltage of the charger.

2. The head driver as set forth in claim 1, wherein the anomalous voltage detector includes a switching element which changes a conduction state thereof when the charging voltage of the charger is a predetermined value or more.

3. The head driver as set forth in claim 1, wherein the anomalous voltage detector includes a comparator which switches an output level thereof when the charging voltage of the charger is a predetermined value or more.

4. The head driver as set forth in claim 1, wherein the detection signal is output when the charging voltage of the charger is a predetermined value or more.

5. A liquid jetting apparatus, comprising:

a liquid jetting head, provided with nozzle orifices;

piezoelectric elements, associated with the nozzle orifices to eject liquid droplets therefrom;

a head drive circuit, which selectively drives the piezoelectric elements;

a charger, which applies a bias voltage to ground-side electrodes of the piezoelectric elements; and an anomalous voltage detector, which outputs a detection signal in accordance with a charging voltage of the charger.

6. The liquid jetting apparatus as set forth in claim 5, wherein the detection signal is output when the charging voltage of the charger is a predetermined value or more.

7. A method of driving a liquid jetting head provided with piezoelectric elements which are selectively driven to eject liquid droplets, the method comprising steps of:

applying a bias voltage to ground-side electrodes of the piezoelectric elements by a charger;

detecting whether a charging voltage of the charger is predetermined value or more; and outputting an anomalous signal in accordance with a detection result of the charging voltage of the charger.

8. The driving method as set forth in claim 7, wherein the anomalous signal is outputted through a switching element which changes a conduction state thereof when it is detected that the charging voltage is predetermined value or more.

9. The driving method as set forth in claim 7, wherein the anomalous signal is outputted through a comparator which switches an output level thereof when it is detected that the charging voltage is predetermined value or more.

10. The driving method as set forth in claim 7, wherein the anomalous signal is output when it is detected that the charging voltage is the predetermined value or more.

* * * * *